US007806058B2

(12) United States Patent
Saxton et al.

(10) Patent No.: US 7,806,058 B2
(45) Date of Patent: Oct. 5, 2010

(54) TANK CAR STUB SILL ATTACHMENT

(75) Inventors: Gregory J. Saxton, Portland, OR (US); John N. Niosi, Portland, OR (US); Robert D. Woolston, Portland, OR (US)

(73) Assignee: Gunderson LLC, Portland, OR (US)

( * ) Notice: Subject to any disclaimer, the term of this patent is extended or adjusted under 35 U.S.C. 154(b) by 145 days.

(21) Appl. No.: 12/079,856

(22) Filed: Mar. 28, 2008

(65) Prior Publication Data

US 2009/0241799 A1 Oct. 1, 2009

(51) Int. Cl.
*B61D 5/06* (2006.01)

(52) U.S. Cl. ..... 105/362; 105/413

(58) Field of Classification Search ..... 105/358, 105/360, 362, 411, 413, 416; 296/15, 29, 296/30, 209, 187.08
See application file for complete search history.

(56) References Cited

U.S. PATENT DOCUMENTS 3,308,769 A 3/1967 Halcomb et al.
3,645,213 A 2/1972 Taylor
3,742,866 A 7/1973 Needham et al.
3,994,239 A 11/1976 Baker et al.
4,466,356 A 8/1984 Messersmith et al.
4,805,540 A 2/1989 Mundloch et al.
5,351,625 A 10/1994 Culligan et al.
5,467,719 A * 11/1995 Dalrymple et al. ..... 105/362
5,613,739 A * 3/1997 Sands ..... 301/95.11
6,357,363 B1 3/2002 Miltaru
6,557,875 B2 * 5/2003 Schlosser et al. ..... 280/124.153

* cited by examiner

*Primary Examiner*—S. Joseph Morano
*Assistant Examiner*—Zachary Kuhfuss
(74) *Attorney, Agent, or Firm*—Chernoff, Vilhauer, McClung & Stenzel, LLP

(57) ABSTRACT

A head brace and a method for attaching a stub sill to a tank of a railroad tank car by the use of such a head brace. A stub sill includes side plates having ears that extend upward to support the tank near where the head of the tank is attached, and a head brace is welded to the side plates and to the head of the tank in a weld joint that can be continuous along the head brace from the ears of the side plate to the center of the head brace. Doublers may be provided on the sill where the head brace is welded to the side plates.

25 Claims, 9 Drawing Sheets

TANK CAR STUB SILL ATTACHMENT

BACKGROUND OF THE INVENTION

The present disclosure relates to railroad tank cars and in particular relates to attachment of stub sills to the ends of the tank of such a car.

Railway tank cars may be used for carrying a variety of liquid, gaseous, and semi-liquid ladings. Such railway tank cars often include a horizontal, generally cylindrical tank. For many such tank cars, the tank not only carries the lading, but is also used as a primary structural member to carry longitudinal train loads.

These cars typically have stub center sills on each end of the car along with transverse bolster assemblies. The sills carry couplers at their outer ends, and the bolsters have truck assemblies pivotally connected thereto to support the ends of the tank car on the railway tracks. Saddle assemblies, combined with the bolster assemblies, are typically provided at each end of the car. The saddle assembly usually is mated with a doubler plate or saddle pad that is attached to the tank. The saddle pad is typically of steel plate construction and conformed to fit onto the adjacent outer surface of the cylindrical tank.

Each end of the tank typically has a convex head and a doubler plate or head pad of steel plate. In securing the stub center sill to the tank a head brace, typically a U-shaped, wedge-like piece, is placed between the head pad and portions of the stub center sill. It has been conventional to weld the head brace into place, but such welds have been subject to a significant number of fatigue cracks on the head braces or the weld joints associated with the head braces.

SUMMARY

According to the present disclosure, a railroad tank car, and a method for assembling a portion of such a tank car, defined by the claims appended hereto, are provided in which a head brace is included in the connection between a stub center sill and the tank, with the interconnection between the stub center sill, the head brace, and the tank being accomplished so as to avoid potential stress concentrations and consequent stress fractures.

In one embodiment of such a railroad tank car a stub center sill includes upwardly extending ears included in side plates of the stub center sill, with the ears extending along and conforming to the shape of the tank in a transitional area between a cylindrical portion and the head of the tank, and a head brace includes arms that lie partly alongside and are welded to the ears.

In one embodiment of the railroad tank car disclosed herein, a doubler plate extends alongside and is welded to the laterally outer face of a side plate of a stub center sill alongside upwardly extending ear portions of the side plates and adjacent an inboard end of a head brace where it overlaps the ears of the side plates.

In one embodiment of the tank car disclosed herein, a head brace rests atop and is welded to a top plate of the stub center sill, and the stub center still has side plates that include a step against which inboard ends of the side portions of the head brace abut.

In accordance with a method disclosed herein, a stub center sill may be connected to the tank of a tank car through a continuous weld joint extending, without a weld termination, along the entire distance from a body bolster along the top of the stub center sill and the head brace.

The foregoing and other features of the disclosures herein will be more readily understood upon consideration of the following detailed description of embodiments taken in conjunction with the accompanying drawings.

DETAILED DESCRIPTION OF PREFERRED EMBODIMENTS

Figure 1:
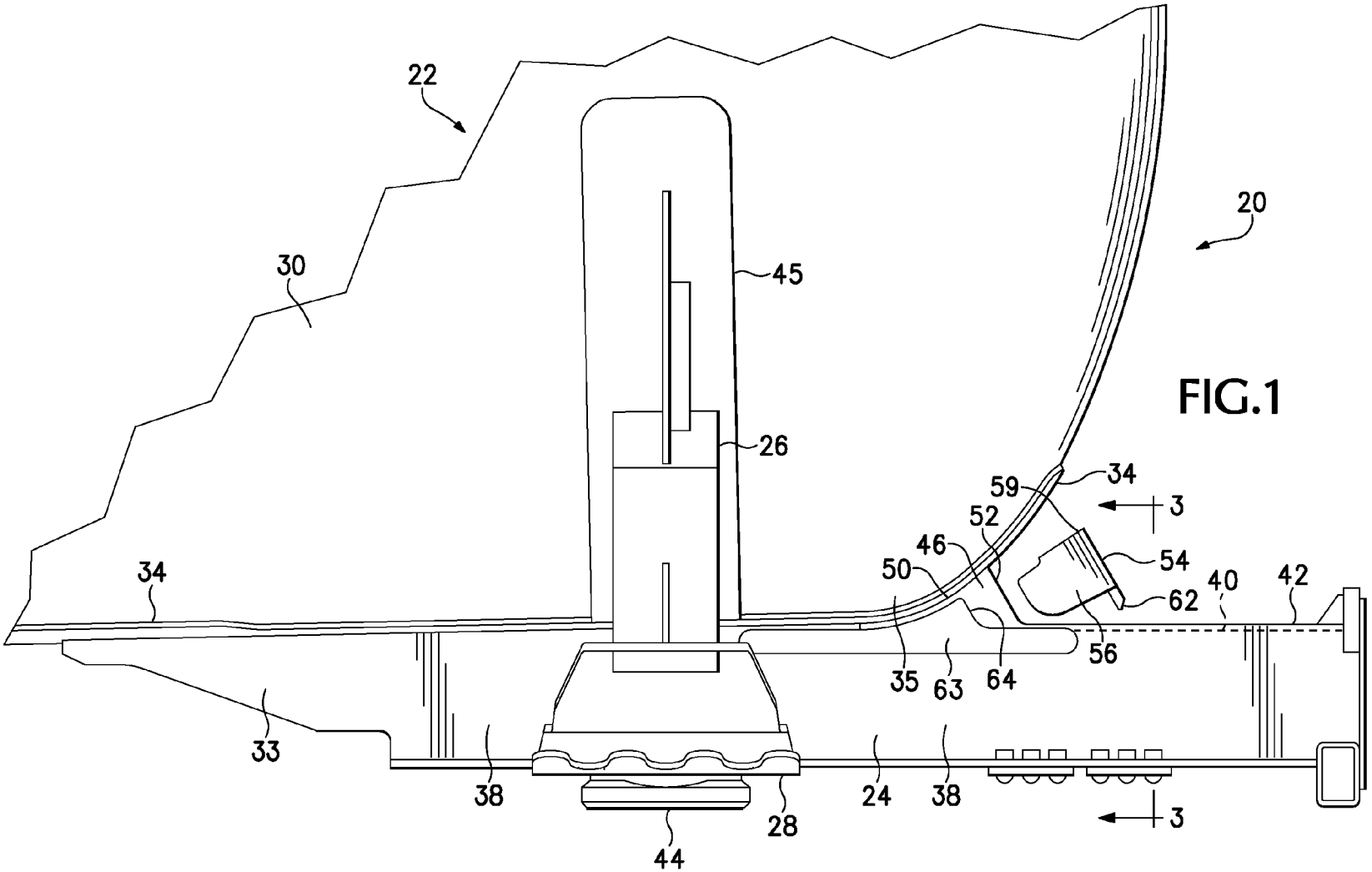
FIG. 1 is a partially exploded side elevational view of a portion of a railroad tank car, including a stub center sill, a saddle, a bolster, and a portion of the tank, and showing a tank head brace according to an embodiment of the disclosure herein.

Referring now to the drawings which form a part of the disclosure herein, a portion of a railroad tank car 20 includes a tank 22 of steel or other suitable metal and intended for carrying liquid cargo, supported by a stub center sill 24 to which a tank saddle 26 is attached. Conventionally, the saddle 26 extends from a bolster 28 and around a generally cylindrical part 30 of the tank 22 a short distance longitudinally inboard from the convex head 32 of the tank 22. The stub center sill 24 may extend for distance inboard beyond the bolster 28 toward the center of the length of the car 20, as at 33.

As shown here, and in most cases, a doubler plate or head pad 34 of steel is present on a portion of the bottom of the tank above the stub center sill 24, extending around a transitional part 35 of the shape of the tank and onto the head 32, to receive and distribute into the tank 22 various forces applied to the center sill 24 during operation of a train including the car 20.

Figure 2:
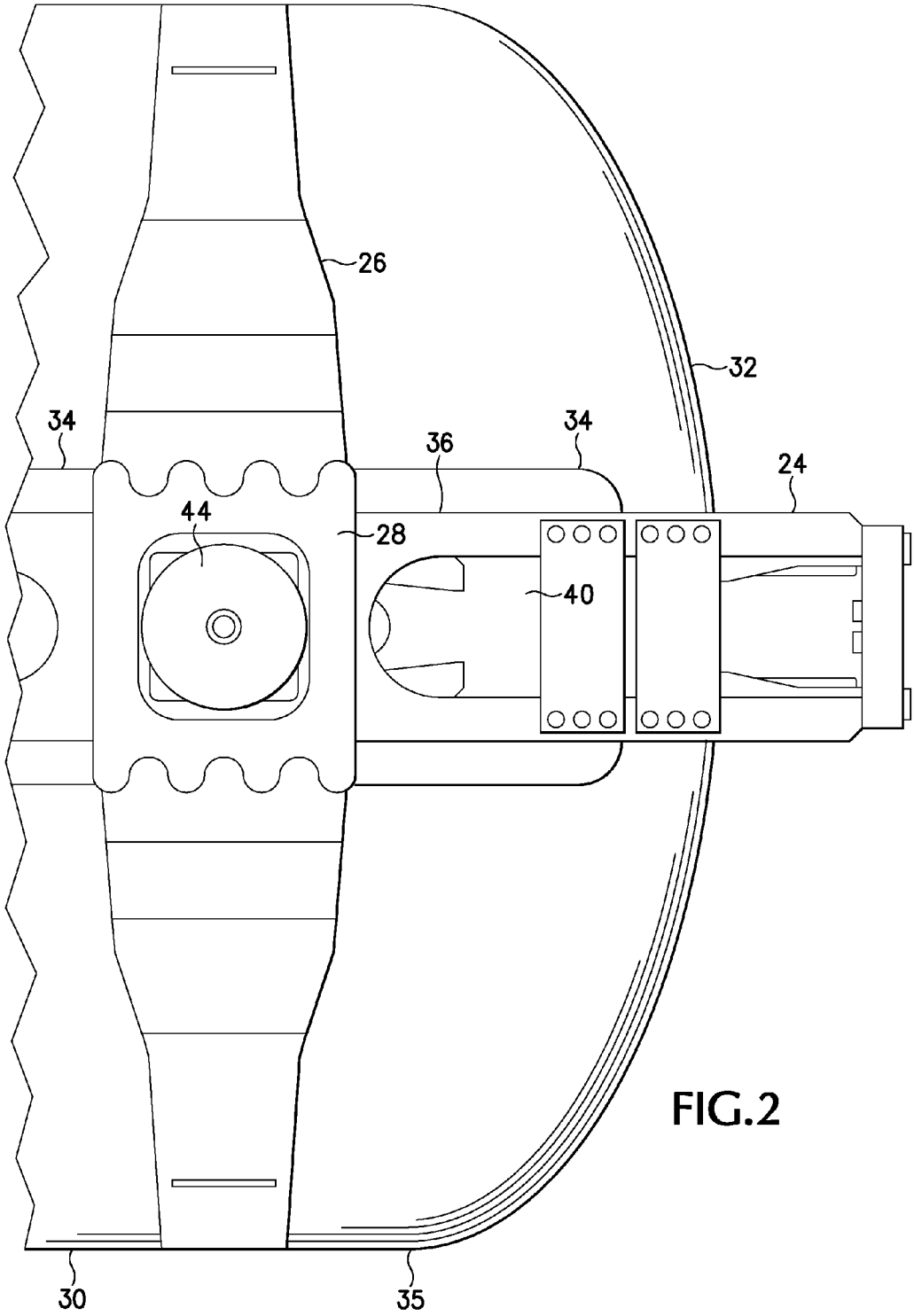
FIG. 2 is a bottom plan view of the portion of a tank car shown FIG. 1.
Figure 3:
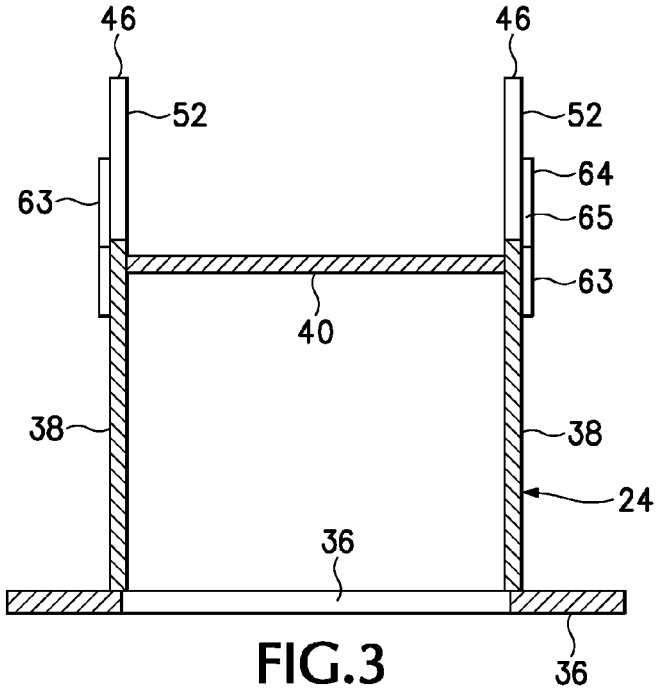
FIG. 3 is a sectional view of the stub center sill of the tank car shown in FIGS. 1 and 2, taken along line 3-3 of FIG. 1.

The stub center sill 24, as may be seen with reference also to FIGS. 2 and 3, includes a bottom cover plate 36 to which are welded a pair of web or side plates 38 that are spaced apart from each other laterally, and as to which the bottom cover plate 36 extends laterally outward on each side of the sill 24. In an outboard end portion of the stub center sill 24 a top cover plate 40 extends horizontally between and is welded to the side plates 38 a small distance beneath the top margin 42 of each of the side plates 38.

A conventional center bearing 44 may be provided on the bolster 28 at the bottom of the center sill 24, and the saddle 26 extends laterally from the bolster 28 and is welded to a doubler plate 45 that is mounted on the exterior of the tank 22 and extends circumferentially upward toward the middle of the height of the tank's generally cylindrical part 30.

A portion of the upper margin 42 of each side plate 38 of the stub center sill 24 is shaped to fit against the bottom or outer surface of the head pad 34, along the bottom of the cylindrical portion 30. An ear-like portion 46 of each side plate 38 extends upward above the mainly horizontal part of the upper margin 42 and has a concave upper margin shape at 50, fitting closely to the head pad 34 in the transitional portion 35 of the tank 22. An outboard margin 52 of each ear 46 may be straight and may be sloped downward and outward, longitudinally of the car 20, toward a horizontal portion of the upper margin 42 extending further outboard, away from the tank 22.

Figure 4:
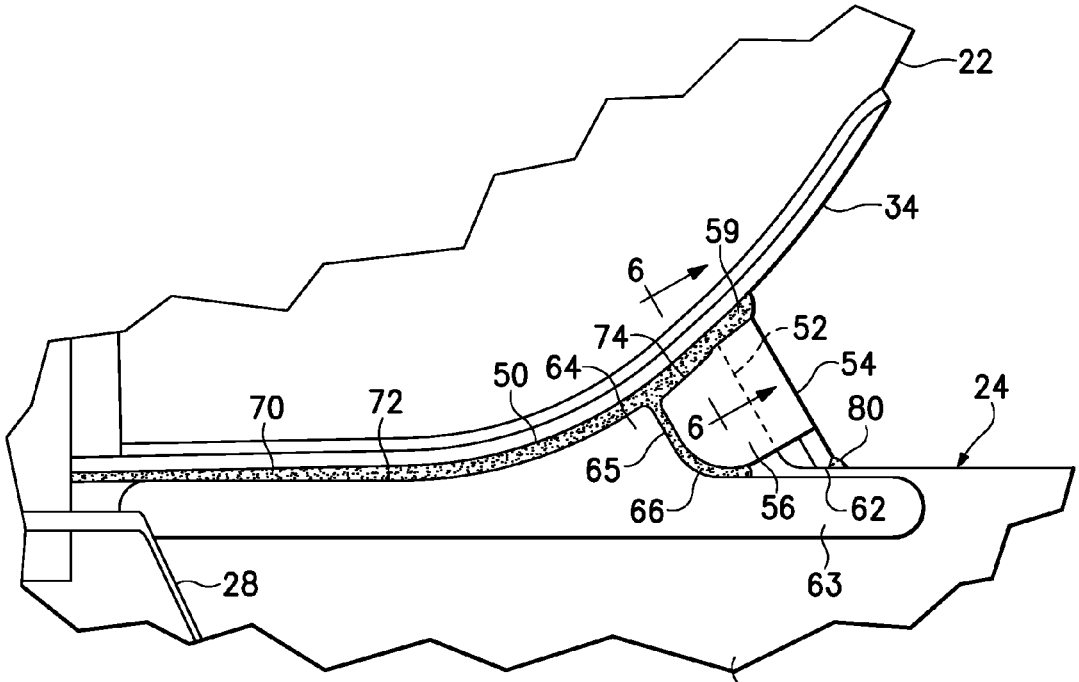
FIG. 4 is a side elevational view of a detail of the attachment of the tank to the stub center sill of the tank car shown in FIG. 1, at an enlarged scale.
Figure 5:
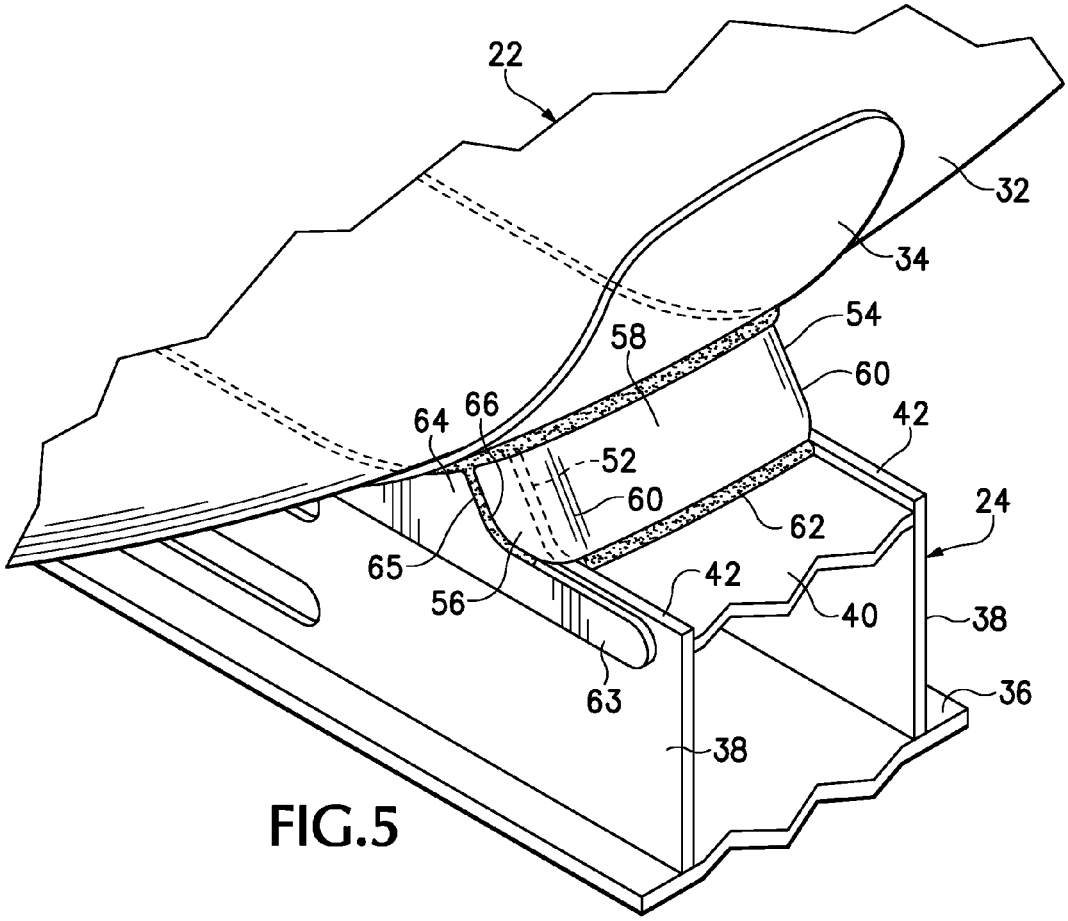
FIG. 5 is an isometric view of the portion of the tank car shown in FIG. 4.
Figure 6:
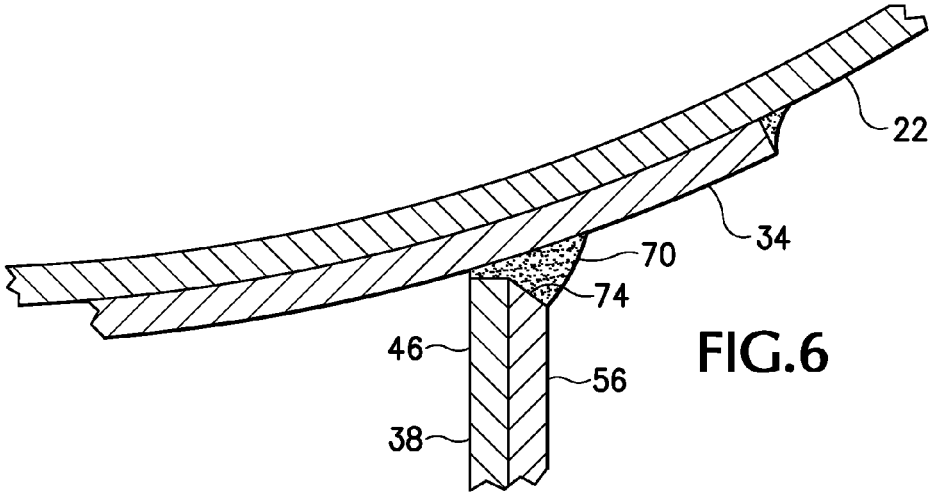
FIG. 6 is a sectional view taken along line 6-6 in FIG. 4.
Figure 7:
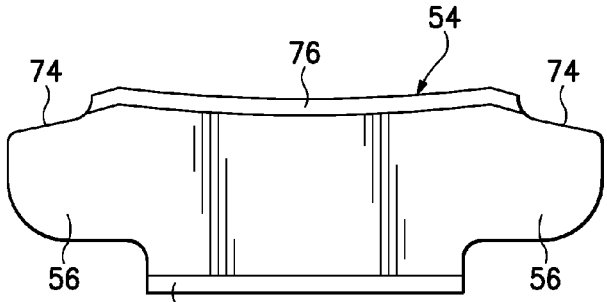
FIG. 7 is view of a blank for the head brace shown in FIGS. 1, 4, and 5, in a flat condition, prior to being bent to shape.
Figure 8:
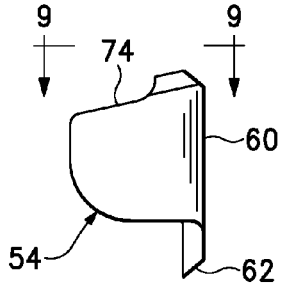
FIG. 8 is a side view of the head brace shown in FIG. 7, after being bent to shape.

A generally U-shaped head brace 54, shown in FIG. 1 exploded away from its installed position, but shown installed in its proper place in FIGS. 4 and 5, has a pair of longitudinally-extending side portions or arms 56 and a transversely-extending central part 58, all of which may be formed by bending an appropriately shaped flat plate to the final shape as in bends 60, as may also be seen in FIGS. 6, 7, and 8. The side portions 56 overlap and extend closely alongside portions of the laterally outer sides of the ears 46 of the side plates 38. The upper margin 59 of the head brace 54, along the bends 60 and the central part 58, fits closely against and is welded to the doubler pad 34 on the head 32 of the tank 22. The bottom, or outer margin 62 of the central part 58 of the head brace 54 extends laterally along and in close contact with the top surface of the top cover plate 40 of the center sill 24, and is welded to it.

As may best be seen in FIGS. 4 and 6, the upper margin 59 is shaped along the side portions 56 so that there is clearance for welding the ear portion 46 to the head pad 34, and there is also clearance for welding the upper margin 59 of the head brace to the doubler pad 34, along the side portions 56, the bends 60, and the central part 58.

A doubler plate 63 may be provided along the upper portion of each side plate 38 of the stub center sill 24. The doubler plates 63 extend generally longitudinally, from a location longitudinally outboard of the bolster 28 to a location longitudinally outboard beyond the head brace 54. After the stub center sill is assembled to include the bottom plate 36, side plates 38, and top cover plate 40, the doubler plates 63 are welded in place on the laterally outward sides of the side plates 38. The doubler plate 63 are intended to reinforce the side plates 38, but may be of thinner material than that of the side plates 38. For example, the side plates 38 may be of 9/16 inch thick steel plate, and the doubler plates 63 may be of ¼ inch thick plate, as may best be seen in FIG. 3.

A small ear 64 on each doubler plate 63 protrudes upward to fit along the surface of the doubler pad 34. A longitudinally outboard margin portion 65 of the ear 64 corresponds in shape to the adjacent portion of the margin of the arm 56 of the head brace 54. As may be seen in FIG. 4, the arms 56 of the head brace 54 are welded to the sloping outboard margins 65 of the ears 64 in weld joints 66 that extend away from the tank 22 and the head pad 34.

Referring also to FIG. 6, a weld joint 70 extends along the upper margins 42 of the side plates 38 from the bolster 28 and continues forward along the upper margin 72 of the doubler plate 63 and the upper margins of the ear 46 of the side plate 38 and the ear 64 of the doubler plate 63, along the upper margin 74 of the arm 56 of the head brace 54 and also along the upper margin 76 of the head brace 54 through the bend 60 and to the central portion 58 of the head brace 54. The tank 22, including the lower part of the head 32 and the head pad 34, thus rests on and is welded to the side web plates 38 of the stub center sill 24. The weld joint 70 forming such a connection can thus be made as a continuous weld along the stub center sill web side plate 38 from the outboard side of the bolster 28 along the bottom of the tank 22 and through the transitional part of the tank 22 onto the head pad 34.

In order to provide a secure weld joint 70, several welding passes will ordinarily be required and used, but there is no weld joint termination required within the entire length of the weld joint 70, from the outboard side of the bolster 28 along the upper margin 42 of the side plates 38, along the upper margin 72 of the doubler plates 63, and the upper margin 59 of the head brace 54, so that the interconnection between the head brace and the tank 22 through the doubler pad 34 is free of weld joint terminations which would, as in previous head brace attachment weld joints, tend to produce stress concentrations that could lead to cracks and failures of interconnection of a stub center sill 24 to the cargo tank 22 of a tank car 20.

The head brace 54, as may be seen in FIGS. 4 and 5, is generally wedge-shaped as seen in side view, and the outboard surface of its central part 58 extends at an outward and downward slope toward the top plate 40 of the stub center sill 24. The bottom, outboard, margin 62 of the head brace 54 is welded to the top plate 40 in a weld joint 80.

Figure 9:
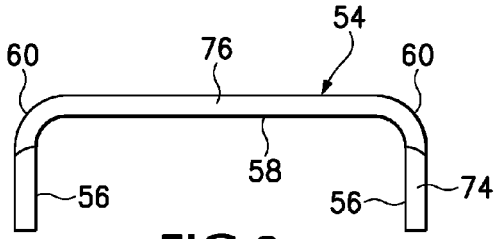
FIG. 9 is a view along the head brace shown in FIG. 7, taken in the direction of line 9-9 in FIG. 8.

The head brace 54 may be fashioned from metal plate of an appropriate thickness, for example steel plate ½ inch thick, as shown in FIG. 7, in which the plate is shown laid out flat and cut to the required shape. The plate is bent appropriately to its final shape, as shown in side view in FIG. 8 and shown as viewed edgewise along the plate in FIG. 9, where the bends 60 interconnecting the central part 58 with the rearwardly extending parallel arms 56 may be seen clearly. As may be seen most clearly in FIGS. 5 and 9, the head brace 54 is of a simple shape with its central part 58 and its arms 56 being generally planar, interconnected by the bends 60.

Figure 10:
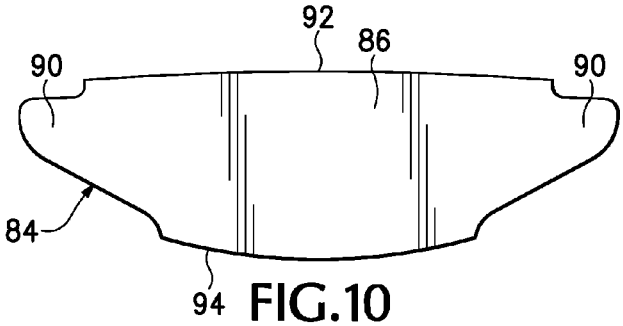
FIG. 10 is a view similar to FIG. 7 showing a blank for a head brace of a somewhat different shape in a flat condition before being bent to shape.
Figure 11:
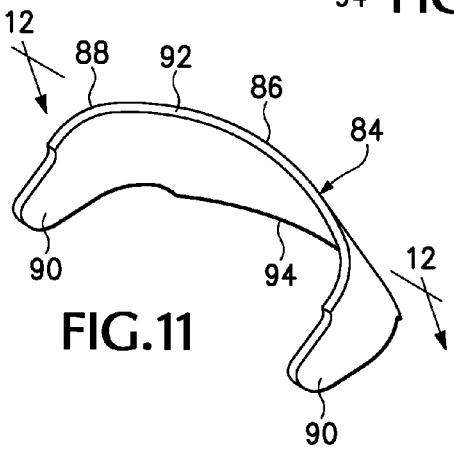
FIG. 11 is an isometric view of the head brace shown in FIG. 10 after being bent to shape.
Figure 12:
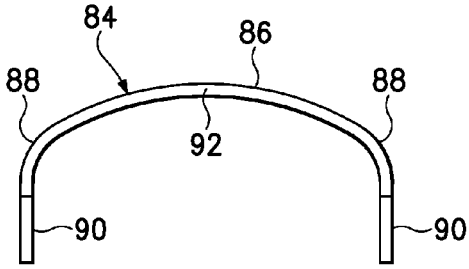
FIG. 12 is a view of the head brace shown in FIGS. 10 and 11, taken in the direction of line 12-12 in FIG. 11.

Head braces of various other shapes can be used in joining the stub center sill 24 to the tank 22 with a similarly continuous weld joint 70 extending from the outboard side of the bolster 28 along the stub center sill 24 and the particular head brace without any weld terminations which could present a risk of failure because of stress concentrations. As shown in FIGS. 10, 11, and 12, an alternative head brace 84, shown in FIG. 10 as a flat blank of plate metal cut to the appropriate shape, may be bent in a central part 86 to have a larger first radius of curvature, on the order of, for example, 11¾ inches, and may be bent in a pair of outer bends 88 that both have similar but shorter radii of curvature, on the order of, for example, 2¼ inches, to define a pair of parallel arms 90. An upper margin 92 of the central part 86 and the arms 90 can be welded to the head pad 34 of the tank 22 as described above with respect to the head brace 54. The arms 90 may overlap and be welded to the ears 46 of side plates 38 of the stub center sill 24 and to two appropriately shaped margins 65 of ears 64 of doubler plates 63, which may be of somewhat different shape from the shape of the doubler plates 63 shown in FIGS. 4 and 5, in order to conform to the shape of the ends of the arms 90. The lower margin 94 of the head brace 84 is arcuately curved as shown in FIG. 10, but when the head brace 84 is bent to the shape shown in FIGS. 11 and 12 the lower margin 94 defines a plane and fits against the top plate 40 of the stub center sill 24, to which it may be welded as is the bottom margin 62 of the head brace 54.

Figure 13:
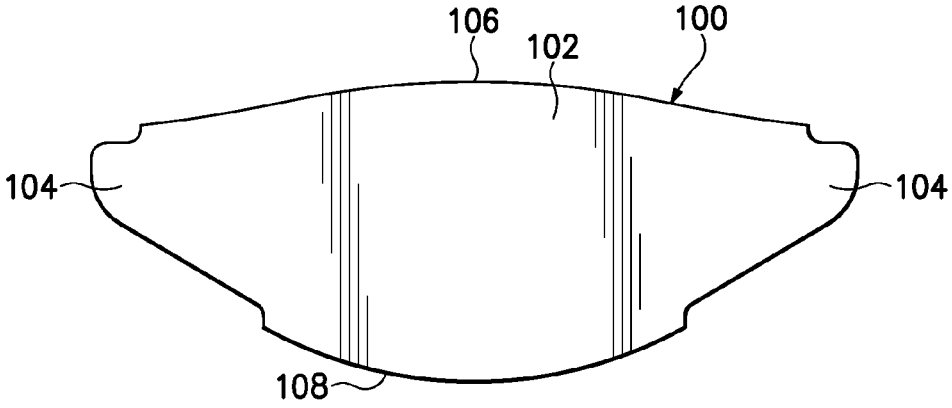
FIGS. 13, 14, and 15 are views similar to FIGS. 10, 11, and 12, respectively, showing a head brace of another somewhat different shape.
Figure 14:
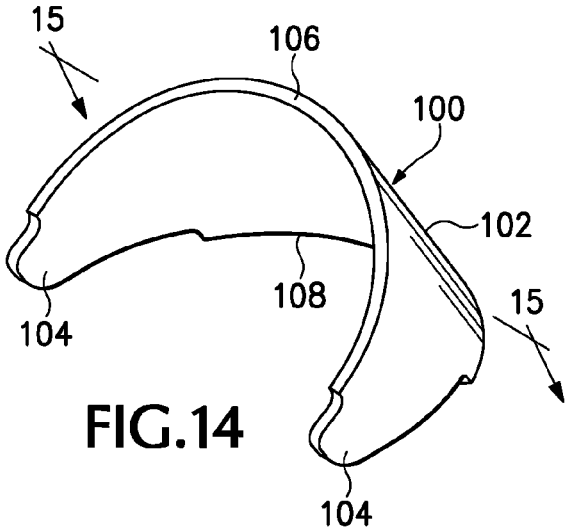
Figure 15:
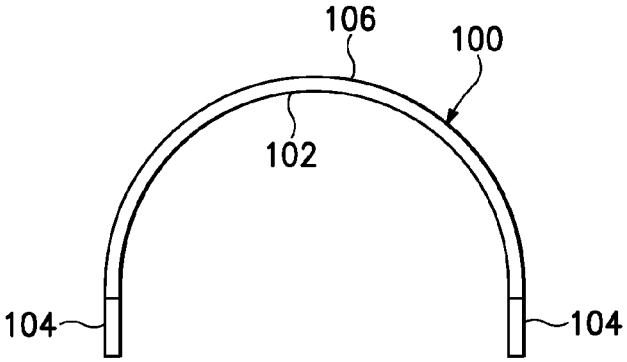

Referring to FIGS. 13-15, a head brace 100 is of yet another alternative configuration, in which a central part 102 is bent from the shape of the flat blank shown in FIG. 13 to the form of a circular semicylinder having a radius of curvature on the order of about 7 inches, while a pair of parallel arms 104 extending from the central part 102 are left substantially planar in order to fit closely alongside the ears 46 of the side plates 38 of the stub center sill 24.

As with the head braces 54 and 84, an upper margin 106 of the head brace 100 is shaped so as to fit snugly against the doubler pad 34 on the head 32 of the cargo tank 22 when the head brace is bent to its intended shape as shown in FIGS. 14 and 15. The lower margin 108 of the bent head brace 100 defines a plane and fits closely atop the cover plate 40 of the stub center sill 24 in order to be welded to it when the head brace 100 is in place against the tank 22 and with its arms 104 in position alongside the ears 46.

The head braces 84 and 100 can thus be installed in the same fashion as described above with respect to the head brace 54, without any weld joint termination in a location where resulting stress concentrations might result in failures of the weld joint interconnecting the stub center sill 24, the head brace 100, and the tank 22.

Figure 16:
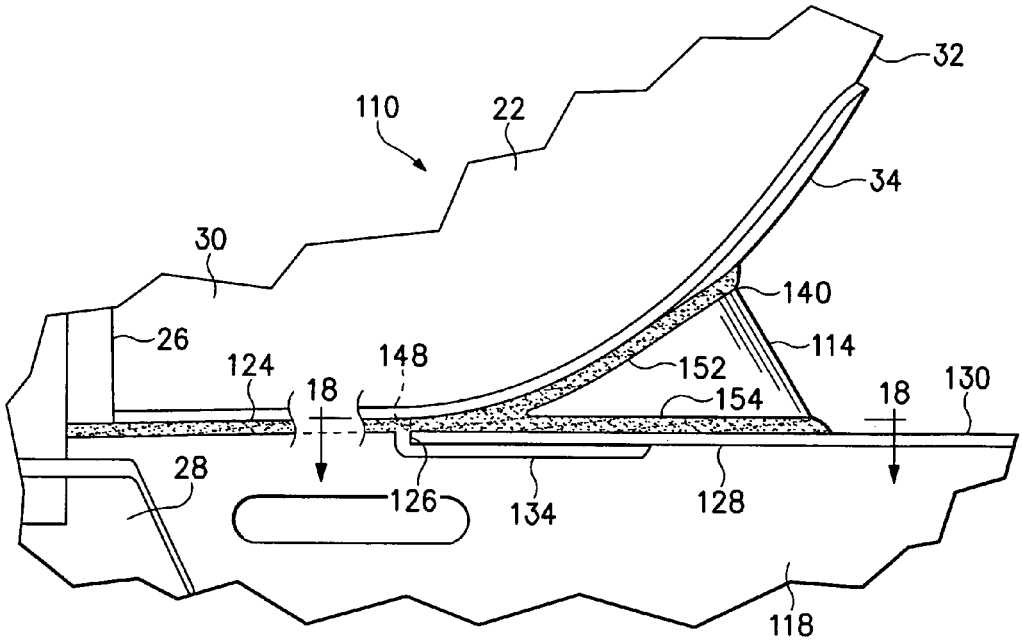
FIG. 16 is a side elevational view of a portion of a tank car, similar to the portion shown in FIG. 4, with a center sill and head brace of a different configuration.
Figure 17:
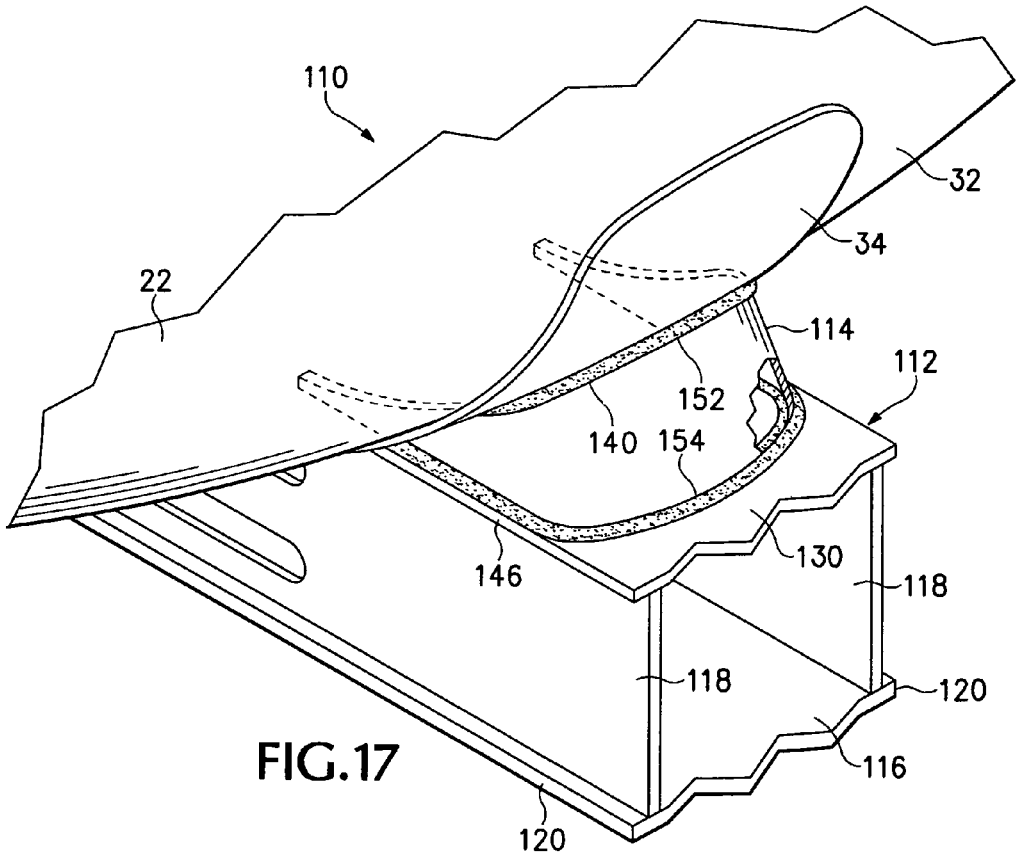
FIG. 17 is an isometric, partially cutaway view of the portion of a tank car shown in FIG. 16.
Figure 18:
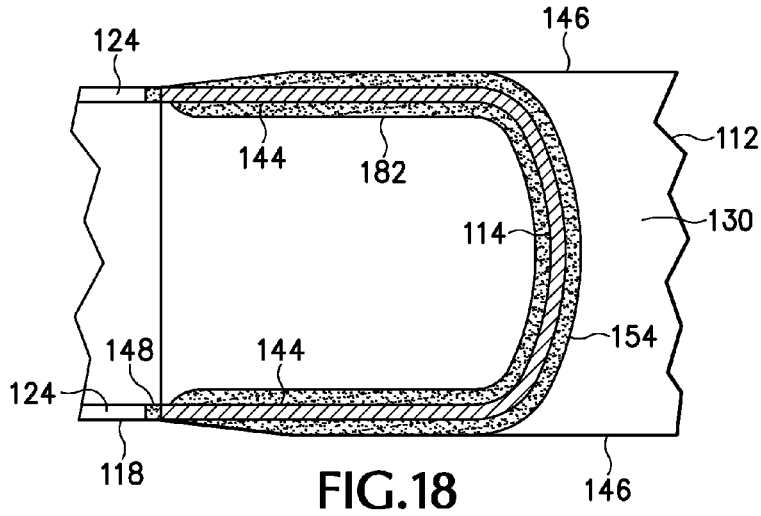
FIG. 18 is a sectional view taken along line 18-18 in FIG. 16.

Referring next to FIGS. 16-18, a railroad tank car 110 includes a tank 22 including a doubler pad 34 attached to a stub center sill 112 in an interconnection including a head brace 114. The stub center sill 112 includes a horizontal bottom plate 116 and a pair of side plates 118 extending upward from the bottom plate 116, parallel with each other and located a small distance inboard from the outer lateral margins of the bottom plate 116. The bottom plate 116 and side plates 118 extend longitudinally of the car 110 to a saddle 26 and bolster 28. As with the tank car 20 shown in FIGS. 1-6, the bottom plate 116 and side plates 118 may extend further inboard toward the longitudinal center of the tank 22 for an appropriate distance, while the stub center sill 112 extends longitudinally outboard so that it can receive a coupler (not shown). Upper margins 124 of the side plates 118 extend longitudinally outboard from the bolster 28 generally horizontally and in contact with the generally horizontal bottom part of the head pad 34 along the longitudinally outer end portion of the generally cylindrical part 30 of the tank 22.

Each of the side plates 118 is shaped to include a step-down face 126 leading to a stepped-down horizontal, longitudinally outwardly extending upper margin portion 128 of each side plate 118, that can be seen in FIG. 16. Atop and welded to the upper margins 128 of the side plates 118 is a horizontal top plate 130 that may be of equal width and located parallel with the bottom plate 116, extending longitudinally outboard from the tank 22. A short portion 134 of each side plate 118 may be beveled as shown in FIG. 16 adjacent to and longitudinally outward from the step-down face 126, beneath the transition portion 35 of the head 32 where it is connected with the cylindrical part 30 of the tank 22. This beveled portion 134 provides a groove for use in welding the top plate 130 to the side plates 118.

The head brace 114 rests atop the top plate 130, with its upper margin 140 welded to the head pad 34 and its lower margin 142 welded to the horizontal top plate 130. The head brace 114 includes a pair of arms 144 that extend parallel with each other along the lateral margins 146 of the top plate 130, as may be seen also in FIG. 18. The arms 144 are long and tapered in height, to fit closely between the top plate 130 and the doubler plate or head pad 34, with longitudinally inboard ends 148 of the arms 144 being located adjacent and welded to the step-down faces 126 of the side plates 118.

A continuous weld joint 152 interconnects the upper margin 140 of the head brace 114 with the head pad 34, and a weld joint 154 interconnects the lower margin 142 of the head brace 114 with the top of the horizontal top plate 130 continuously along portions of the lateral margins 146 and transversely across the top of the horizontal top plate 130, as may be seen best in FIG. 18.

Figure 19:
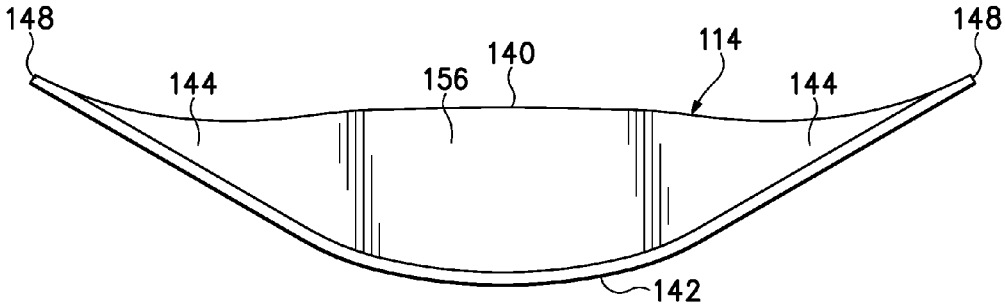
FIG. 19 is a view of a blank for the head brace shown in FIGS. 16, 17, and 18, in a flat form prior to being bent to shape.
Figure 20:
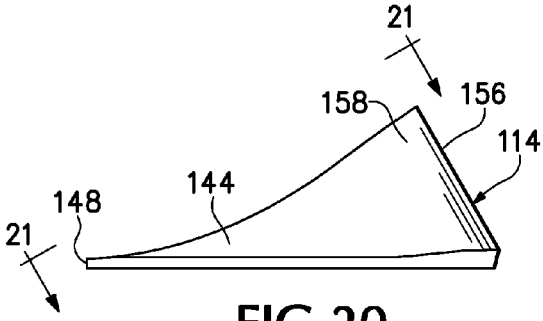
FIG. 20 is a side elevational view of the head brace shown in FIG. 19 after it has been bent to shape for use.
Figure 21:
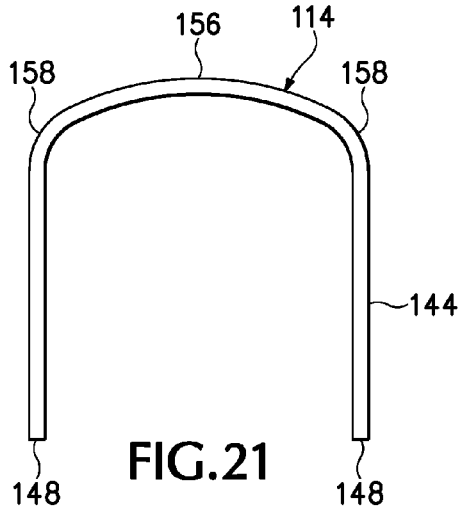
FIG. 21 is a view taken along line 21-21 in FIG. 20, showing the shape to which the head brace is bent.

The head brace 114 may be formed in a fashion similar to that used in formation of the head braces 54, 84, and 100, particularly the head brace 84 shown in FIGS. 10-12. As shown in FIG. 19 the head brace 114 may be cut from appropriately thick flat plate material to provide an appropriately arcuately shaped upper margin 140 and lower margin 142, and to include portions that will become the arms 144. The lower margin 142 may be beveled as seen best in FIG. 20. As with the head brace 84, a central part 156 is bent arcuately with a first radius of curvature which may be relatively long, while bend portions 158 adjacent the planar, parallel, arms 144 may be formed with a relatively small radius of curvature.

Figure 22:
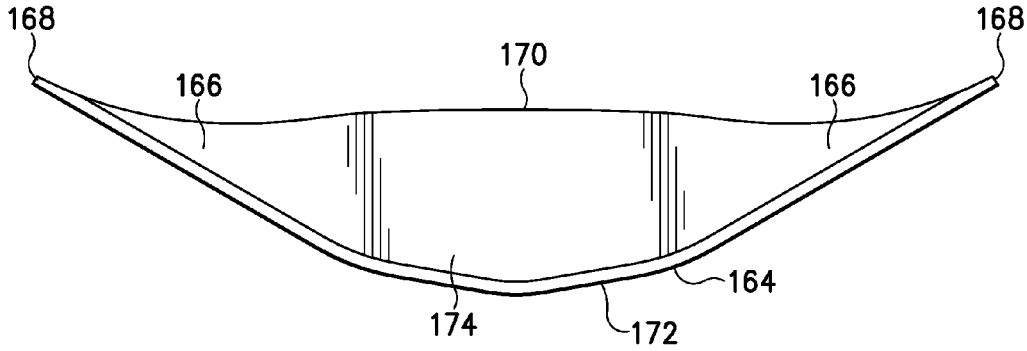
FIGS. 22-24 are views similar to FIGS. 19-21, respectively, showing a head brace of a slightly different alternative configuration.
Figure 23:
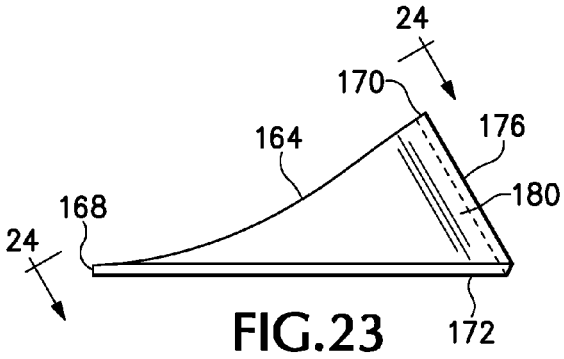
Figure 24:
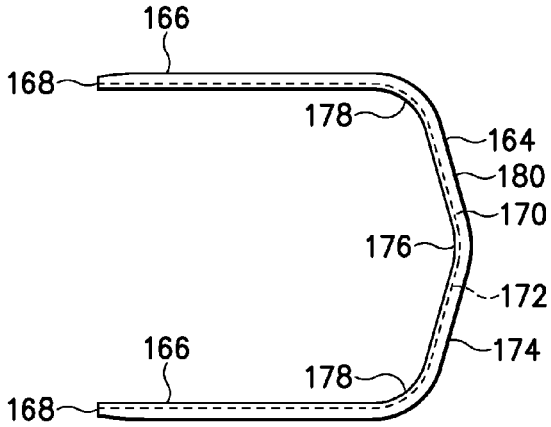

As an alternative to the head brace 114, a slightly different head brace 164, shown in FIGS. 22-24, may be used. The head brace 164 also includes a pair of arms 166 that extend parallel with each other to fit along the lateral margins 146 of the top plate 130 when the head brace 164 is in place. The arms 166 are also long and tapered in height, to fit between the top plate 130 and the head pad 134, with longitudinally inboard ends 168 of the arms 166 being located adjacent and being welded to the step-down faces 126 of the side plates 118.

The head brace 164 may also be formed in a fashion similar to that used in formation of the head brace 84 shown in FIGS. 10-12. As shown in FIG. 22 the head brace 164 may be cut from appropriately thick flat plate material to provide an appropriately arcuately shaped upper margin 170 and lower margin 172, and to include portions that will become the arms 166. The lower margin 172 may be beveled as seen best in FIG. 23.

Unlike the head brace 114 a central part 174 is bent arcuately at each of three bends, a central bend 176 and two side bends 178 adjacent the planar, parallel arms 166. Each of the bends 176 and 178 may be formed with a relatively small radius of curvature, so that two flat panels 180 are defined between the central bend 176 and the side bends 178, as may be seen in FIG. 24.

A tank car 20 as described above may be assembled by first fastening a preformed head 32 to the cylindrical part 30 of the tank and then attaching the head pad 32 and the doubler plate 45 to the tank 22.

The stub center sill 24, body bolster 28, and saddle 26 may be assembled and supported appropriately to receive the tank 22. The tank 22 may be lowered into position atop the assembled bolster 28, saddle 26, and stub center sill 24, or the tank 22 may be appropriately supported while the bolster 28, saddle 26, and stub center sill 24 are raised into position against the bottom of the tank 22, in contact against the circumferential doubler plate 45 and the head pad 34 and may be tack welded into the desired position. The bolster 28 and saddle 26 may be welded completely to the doubler plate 45. Alternatively, the bolster 28 and saddle 26 may be assembled and fastened to the tank 22 as a later step.

With the stub center sill 24 held in place, as by being tack welded to the tank 22, the appropriate head brace 54, 84, or 100, may be placed into position with its arms 56, 90, or 104 closely alongside and overlapping the ears 46 of the side plates 38, and with the upper margin 76, 92, or 106 in contact against the head pad 34, and the lower margin 62, 94, or 108 resting atop the cover plate 40.

The inboard-facing ends of the arms 56, 90, or 104 of the head brace 54, 84, or 100 are welded to the ears 46 as at 66 in FIGS. 4 and 5, thus holding the head brace in place fitting snugly against the tank pad 34 and the top plate 40.

Once the stub center sill 24 is in place against the bottom of the head pad 34, and the head brace 54, 84, or 100 has been placed into position and has had its arms welded to the ears 46 in a weld 66 extending away from the tank 22, a continuous weld joint 70 can be made. The weld 70 extends from the location of the outboard side of the bolster 28 along the top of the stub center sill 24 and the upper margin 72 of the doubler plate 63, the upper margin 74 of the arms 56, and the upper margin 59 of the head brace 54 and continues further around the head brace 54 and in an inboard direction to the bolster 28 on the opposite side of the car 20. The direction in which the weld joint 70 is completed is not critical, but it may be seen that the weld joint 70 can be continuous, so that there is no need for a weld termination at a location where stresses would likely to be concentrated, and there is no need to terminate a weld in a corner or an arcuately curved portion of the joint between the stub center sill and the head pad 34 of the tank 22.

Similarly, in assembling the tank car 110, with the stub center sill 112 and the head brace 114 or 164 in place against the tank 22 the inboard ends 148 or 168 are welded to the step-down face 126, and the lower margin 172 may be fastened to the top plate 130. A continuous weld can then be made from the bolster along the upper margins 124 of the side web plates 118 and continuing along the upper margin 140 of the head brace 114 to attach the stub center sill 112 to the doubler plate 34 of the tank 22.

With the stub center sill 112 it is also possible to weld the lower margin 142 of the head brace 114 to the upper surface of the horizontal top plate 130 at 182 along the inside of the head brace 114, as may be seen in FIG. 18, before presenting the stub center sill 112 and head brace 114 to the bottom of the tank 22 and its head pad 34 as an assembly. Thus the lower weld joint may include a fillet weld 182 on the interior of the head brace 114 as well as the weld 154 on the exterior of the head brace 114. Procedures are similar for installation of the stub center sill 112 when the head brace 164 is used.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

The invention claimed is:

1. A subassembly for a railroad tank car of the type including a tank having a generally cylindrical tank body and a convex head, the subassembly comprising:

(a) a center sill including a generally horizontal top member and a pair of upright side plates spaced apart laterally from each other, at least one of the side plates including an upwardly extending ear having an upper margin shaped to fit against the tank and welded to the tank; and (b) a head brace including a central part and a pair of arms, the central part of the head brace having a lower margin welded to the top member of the center sill and an upper margin welded to the head of the tank, one of the pair of arms extending alongside and overlapping the ear and being welded to the ear.

2. The subassembly of claim 1 wherein an upper margin of the side plate adjacent the upwardly extending ear, the upper margin of the ear, and the upper margin of the central portion of the head brace are aligned with one another and form a continuous support surface shaped to fit against the tank.

3. The subassembly of claim 2 wherein each of the side plates of the center sill has a respective upwardly extending ear and a respective one of the pair of arms of the head brace overlaps and is interconnected with each of the upwardly extending ears.

4. The subassembly of claim 3 wherein said tank rests on said center sill in contact with the upper margins of the side plates and the head brace and wherein the side plates including the upper margins of the ears and the upper margin of the head brace are welded to the tank along a single continuous weld joint.

5. The subassembly of claim 4 wherein the weld joint is free from weld terminations within a portion of the weld joint extending from the tank head to a location along the upper margin of the side plate located longitudinally inboard from the respective ear thereof.

6. The subassembly of claim 4 wherein the tank includes a doubler plate on an exterior surface thereof and wherein the center sill and head brace are welded directly to the doubler plate.

7. The subassembly of claim 3 including a doubler plate located on an outer side of one of the side plates of the center sill, overlapping a portion of the upwardly extending ear and including a part confronting the respective arm of the head brace, the doubler plate extending longitudinally along the side plate of the center sill beneath a portion of the head brace.

8. The subassembly of claim 7 wherein the doubler plate includes an upper margin welded to the tank alongside the upper margin of the upwardly extending ear of the side plate of the center sill.

9. The subassembly of claim 1 wherein the upper margin of the ear of the at least one of the side plates is shaped to fit against a transitional shoulder portion of the tank where the cylindrical body of the tank merges with the head of the tank.

10. A subassembly for a railroad tank car, comprising:

(a) an elongate cylindrical cargo tank having an end including a convex head, a horizontal longitudinal axis of the cargo tank defining a longitudinal axis of the tank car;

(b) a center sill attached to an underside of the tank at the end of the tank, the center sill including a pair of laterally oppositely located longitudinal, upright, side plates;

(c) an upwardly projecting ear included in at least one of the side plates, the ear having a concavely arcuate upper margin conforming to a transitional portion of the tank and a radially outermost portion of the convex head; and (d) a U-shaped head brace having a pair of arms, one of the arms lying alongside and overlapping a portion of the ear of a respective one of the side plates, the head brace having an upper margin conforming to and welded to a portion of the head of the tank and having a lower margin welded to a top plate of the center sill.

11. The subassembly for a railroad tank car of claim 10, wherein the head brace is attached to the ear by a weld joint extending away from the tank.

12. The subassembly of claim 10 wherein the tank includes a head pad in the form of a doubler plate extending over a portion of an underside of the tank and a portion of the convex head of the tank.

13. The subassembly of claim 10 wherein the upper margin of the head brace includes a part conforming to and lying outwardly alongside the upper margin of the ear.

14. The subassembly of claim 10 wherein the center sill has a doubler plate attached to one of the side plates and where an end of one of the arms of the head brace extends along and parallel to a portion of a margin of the doubler plate that extends away from the tank.

15. The subassembly of claim 10 wherein the center sill is a stub center sill.

16. A method of joining a center sill to a cargo tank of a railroad tank car, comprising:

(a) providing a body bolster and a stub center sill, the body bolster being interconnected with the stub center sill and the stub center still having a pair of longitudinally extending upright laterally apart-spaced side plates each including an upwardly extending ear protruding above a top plate of the stub center sill;

(b) supporting the body bolster and stub center sill in a predetermined orientation;

(c) moving one of the cargo tank and the stub center sill to bring the cargo tank and the stub center sill together into a mating position in which the cargo tank is atop the center sill and the body bolster and with the cargo tank in contact with the side plates;

(d) placing a generally U-shaped head brace into position atop the center sill with an arm of the head brace resting closely alongside and aligned with an outboard side of an ear, so that a laterally central outwardly facing part of the head brace is inclined longitudinally inward and upward from the center sill toward a convex head of the tank and an upper margin of the head brace abuts against the head of the tank;

(e) welding a portion of a margin of the arm to a respective one of the ears while keeping the head brace in a position in which the upper margin of the head brace is in contact with the head of the tank; and (f) thereafter, fastening a portion of an upper margin of one of the side plates and an adjacent portion of an upper margin of the head brace to the head of the tank, by forming a continuous weld joint, the weld joint extending from a location on the one of the side plates longitudinally outboard of the body bolster to a laterally central part of the upper margin of the head brace.

17. The method of claim 16 including supporting the body bolster and stub center sill adjustably and adjusting the position of the body bolster and stub center sill with respect to the tank in order to facilitate placing the tank into the mating position atop the center sill and body bolster.

18. The method of claim 16 including the step of welding a lower margin of the arm of the head brace to the respective one of the side plates of the sill before performing the step of fastening the upper margin of the head brace to the head of the tank.

19. The method of claim 16 including the additional steps of installing a doubler plate on one of the side plates so that a portion of the doubler plate extends onto the ear of the side plate, and welding an upper longitudinally outboard margin of the doubler plate to a lower longitudinally inboard portion of a margin of the head brace.

20. A method of attaching a head brace to a tank and a center sill of a railroad tank car, comprising:

(a) placing a portion of an arm of a U-shaped head brace into an overlapping position with respect to an upwardly extending ear portion of a side plate of a center sill, with an upper margin of the head brace lying closely against a convex head of the tank and with a lower margin of the head brace extending closely along an upper surface of the center sill;

(b) welding the arm of the head brace to the ear portion; and (c) thereafter, forming a continuous weld joint interconnecting the side plate and the head brace with the tank, the weld joint extending along the ear of the side plate and the upper margin of the head brace continuously from a position along the side plate inboard from the ear, along the ear, and along the head brace, at least to a laterally central portion of the upper margin of the head brace.

21. A subassembly for a railroad tank car of the type including a tank having a generally cylindrical tank body and a convex head, the subassembly comprising:

(a) a center sill including a pair of upright side plates spaced apart laterally from each other, each of the side plates including an upper margin shaped to fit against a cylindrical body of the tank and including a step-down face adjacent a transitional part of the tank;

(b) a generally horizontal top member mounted atop a portion of the side plates, the horizontal top member extending laterally outboard beyond each of the side plates and extending longitudinally outboard from the step-down faces and beneath the transitional part and a head of the tank;

(c) a head brace including a generally transversely extending central part and a pair of generally longitudinally extending arms, the central part of the head brace having a lower margin welded to the horizontal top member of the center sill and an upper margin welded to the head of the tank, and an inboard end of each of the arms being welded to the step-down face of a respective one of the side plates;

(d) the upper margins of the side plates at a location longitudinally inboard from the step-down face, the upper margins of the arms, and the upper margin of the central portion of the head brace being aligned with one another and forming a continuous support surface shaped to fit against the tank; and wherein (e) the tank rests on the center sill in contact with the upper margins of the side plates and the head brace and wherein the side plates and the upper margin of the head brace are welded to the tank along a continuous weld joint that extends uninterrupted along the upper margins of the side plates from the location longitudinally inboard from the step-down face and along the upper margin of the head brace, and that interconnects the side plates and the upper margin of the head brace with the tank.

22. The subassembly of claim 21 wherein the tank includes a head pad in the form of a doubler plate extending over a portion of an underside of the tank and a portion of the head of the tank.

23. The subassembly of claim 21 wherein the center sill is a stub center sill.

24. A method of joining a center sill to a cargo tank of a railroad tank car, comprising:

(a) providing a stub center sill and a body bolster attached thereto, the stub center sill having a pair of longitudinally extending upright laterally apart-spaced side plates and a horizontal top plate mounted atop longitudinally outboard portions of the side plates;

(b) supporting the stub center sill in a predetermined position;

(c) placing a generally U-shaped head brace having a pair of arms into position atop the top plate of the stub center sill with an inboard end of each arm of the head brace aligned with a respective one of the side plates and an outwardly facing part of the head brace inclined longitudinally inward and upward from the stub center sill;

(d) welding a lower margin of each arm of the head brace to the top plate of the stub center sill; and (e) thereafter moving one of the stub center sill and the cargo tank to place the cargo tank into a mating position atop the stub center sill and the body bolster with the cargo tank in contact with the side plates; and (f) thereafter fastening an upper margin of one of the side plates and the adjacent portion of the upper margin of the head brace to the head of the tank by forming a weld joint extending continuously and free from weld terminations, along an exterior of the side plate and the head brace, from a location on the side plate longitudinally outboard of the body bolster to a laterally central part of the upper margin of the head brace.

25. The method of claim 24 including supporting the stub center sill adjustably and adjusting the position of the stub center sill with respect to the tank in order to facilitate lowering the tank into the mating position atop the stub center sill.

* * * * *